US009035740B2

(12) United States Patent
Washizaki et al.

(10) Patent No.: US 9,035,740 B2
(45) Date of Patent: May 19, 2015

(54) CIRCUIT PROTECTIVE DEVICE AND METHOD FOR MANUFACTURING THE SAME

(75) Inventors: Tomoyuki Washizaki, Fukui (JP); Toshiyuki Iwao, Fukui (JP); Takashi Kitamura, Fukui (JP); Takashi Watanabe, Fukui (JP); Naohiro Mikamoto, Fukui (JP); Masahito Fuchigami, Fukui (JP); Kazutoshi Matsumura, Fukui (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 708 days.

(21) Appl. No.: 12/739,980

(22) PCT Filed: Nov. 6, 2008

(86) PCT No.: PCT/JP2008/003203

§ 371 (c)(1),
(2), (4) Date: Apr. 27, 2010

(87) PCT Pub. No.: WO2009/060607

PCT Pub. Date: May 14, 2009

(65) Prior Publication Data

US 2010/0245028 A1 Sep. 30, 2010

(30) Foreign Application Priority Data

| | | |
|---|---|---|
| Nov. 8, 2007 | (JP) | 2007-290314 |
| Jan. 18, 2008 | (JP) | 2008-008870 |
| Mar. 26, 2008 | (JP) | 2008-079619 |
| Aug. 26, 2008 | (JP) | 2008-216130 |

(51) Int. Cl.
*H01H 85/04* (2006.01)
*H01H 69/02* (2006.01)

(Continued)

(52) U.S. Cl.
CPC ..... *H01H 69/022* (2013.01); *Y10T 29/49107* (2015.01); *H01H 85/0039* (2013.01); *H01H 85/046* (2013.01); *H01H 85/08* (2013.01)

(58) Field of Classification Search
CPC ... H01H 69/022; H01H 85/08; H01H 85/046; H01H 85/0039
USPC ..... 337/297, 159, 227, 295; 29/623
See application file for complete search history.

(56) References Cited

U.S. PATENT DOCUMENTS 4,308,514 A * 12/1981 Kozacka ..... 337/159
4,538,756 A * 9/1985 Trenkler et al. ..... 228/118

(Continued)

FOREIGN PATENT DOCUMENTS

JP 1-228101 9/1989
JP 04-033230 2/1992

(Continued)

OTHER PUBLICATIONS

International Search Report issued Jan. 20, 2009 in International (PCT) Application No. PCT/JP2008/003203.

*Primary Examiner* — Anatoly Vortman
(74) *Attorney, Agent, or Firm* — Wenderoth, Lind & Ponack, L.L.P.

(57) ABSTRACT

A circuit protecting element includes insulating substrate (11), a pair of surface electrodes (12) provided to both ends of a top face of insulating substrate (11), element (13) bridging the pair of surface electrodes (12) and electrically connected to the pair of surface electrodes (12), base layer (14) formed between element (13) and insulating substrate (11), and insulating layer (15) covering element (13). Base layer (14) is formed of a mixture of diatom earth and silicone resin. The structure discussed above allows stabilizing the blowout characteristics of the circuit protecting element.

23 Claims, 8 Drawing Sheets

(51) Int. Cl.

| | |
|---|---|
| ***H01H 85/046*** | (2006.01) |
| ***H01H 85/08*** | (2006.01) |
| *H01H 85/00* | (2006.01) |

(56) References Cited

U.S. PATENT DOCUMENTS

| | | | | | |
|---|---|---|---|---|---|
| 4,626,818 | A | * | 12/1986 | Hilgers | 337/166 |
| 5,367,280 | A | * | 11/1994 | Thiel et al. | 337/297 |
| 5,399,416 | A | * | 3/1995 | Bujard | 428/209 |
| 5,420,560 | A | * | 5/1995 | Hanada | 337/273 |
| 5,450,055 | A | * | 9/1995 | Doi | 338/332 |
| 5,572,181 | A | * | 11/1996 | Kiryu et al. | 337/273 |
| 5,614,881 | A | | 3/1997 | Duggal et al. | |
| 5,680,092 | A | * | 10/1997 | Yamada et al. | 338/309 |
| 5,712,610 | A | * | 1/1998 | Takeichi et al. | 337/290 |
| 5,815,065 | A | * | 9/1998 | Hanamura | 338/309 |
| 5,877,467 | A | | 3/1999 | Arnold et al. | |
| 5,907,274 | A | * | 5/1999 | Kimura et al. | 338/309 |
| 5,917,403 | A | * | 6/1999 | Hashimoto et al. | 338/307 |
| 5,990,781 | A | * | 11/1999 | Kambara | 338/309 |
| 6,040,754 | A | * | 3/2000 | Kawanishi | 337/297 |
| 6,078,245 | A | * | 6/2000 | Fritz et al. | 337/297 |
| 6,087,920 | A | * | 7/2000 | Abramov | 336/192 |
| 6,087,921 | A | * | 7/2000 | Morrison | 336/200 |
| 6,094,123 | A | * | 7/2000 | Roy | 336/200 |
| 6,153,256 | A | * | 11/2000 | Kambara et al. | 427/103 |
| 6,304,167 | B1 | * | 10/2001 | Nakayama | 338/195 |
| 6,388,550 | B1 | * | 5/2002 | Kanetaka et al. | 336/223 |
| 6,452,475 | B1 | * | 9/2002 | Kawazu et al. | 337/290 |
| 6,492,885 | B1 | * | 12/2002 | Murata et al. | 333/185 |
| 6,535,106 | B2 | * | 3/2003 | Teramae | 338/309 |
| 6,724,295 | B2 | * | 4/2004 | Tsukada | 338/309 |
| 6,771,476 | B2 | * | 8/2004 | Fukuoka et al. | 361/103 |
| 6,806,167 | B2 | * | 10/2004 | Kuriyama | 438/460 |
| 6,864,774 | B2 | * | 3/2005 | Kanetaka et al. | 336/83 |
| 6,867,133 | B2 | * | 3/2005 | Kanetaka et al. | 438/678 |
| 6,982,624 | B2 | * | 1/2006 | Saito et al. | 338/309 |
| 7,057,490 | B2 | * | 6/2006 | Hashimoto et al. | 338/309 |
| 7,089,652 | B2 | * | 8/2006 | Akhtman et al. | 29/610.1 |
| 7,173,510 | B2 | * | 2/2007 | Kono et al. | 337/159 |
| 7,380,333 | B2 | * | 6/2008 | Tsukada et al. | 29/610.1 |
| 7,907,046 | B2 | * | 3/2011 | Tsukada | 338/309 |
| 2001/0000215 | A1 | * | 4/2001 | Oh | 338/306 |
| 2002/0097547 | A1 | * | 7/2002 | Fukuoka et al. | 361/118 |
| 2003/0079904 | A1 | * | 5/2003 | Sato et al. | 174/126.4 |
| 2005/0141164 | A1 | * | 6/2005 | Bender et al. | 361/104 |
| 2006/0199031 | A1 | * | 9/2006 | Kistner et al. | 428/621 |
| 2006/0255897 | A1 | * | 11/2006 | Tanaka et al. | 336/83 |
| 2007/0075822 | A1 | * | 4/2007 | Pachla et al. | 337/297 |
| 2008/0081454 | A1 | * | 4/2008 | Sakoh | 438/601 |
| 2008/0191832 | A1 | * | 8/2008 | Tsai | 337/297 |
| 2008/0303626 | A1 | * | 12/2008 | Blum et al. | 337/297 |
| 2009/0009281 | A1 | * | 1/2009 | Wang et al. | 337/297 |

FOREIGN PATENT DOCUMENTS

| | | |
|---|---|---|
| JP | 05-121122 | 5/1993 |
| JP | 5-225892 | 9/1993 |
| JP | 07-231061 | 8/1995 |
| JP | 9-129115 | 5/1997 |
| JP | 9-168233 | 6/1997 |
| JP | 9-246384 | 9/1997 |
| JP | 11-096886 | 4/1999 |
| JP | 2000-279311 | 10/2000 |
| JP | 2001-167909 | 6/2001 |
| JP | 2001-345039 | 12/2001 |
| JP | 2002-056767 | 2/2002 |
| JP | 2002-260447 | 9/2002 |
| JP | 2003-234057 | 8/2003 |
| JP | 2004-319168 | 11/2004 |
| JP | 2006-318896 | 11/2006 |

* cited by examiner

FIG. 9-Prior Art
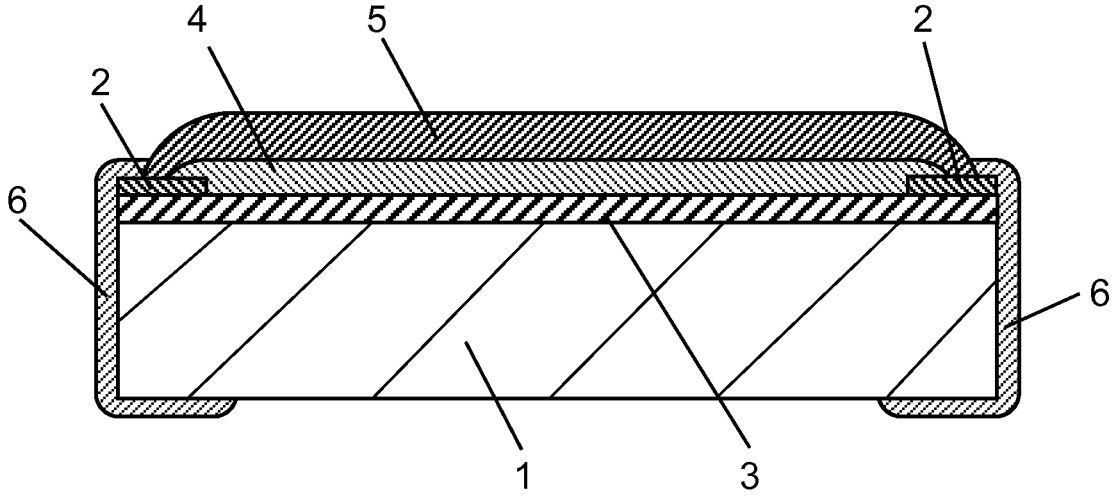

CIRCUIT PROTECTIVE DEVICE AND METHOD FOR MANUFACTURING THE SAME

TECHNICAL FIELD

The present invention relates to a circuit protecting element which is used in a variety of electronic devices and blown out by an over-current for protecting the devices.

BACKGROUND ART

FIG. 9 shows a conventional circuit protecting element (disclosed in Patent Document 1) comprising the following structural elements:

- insulating substrate 1;
- a pair of surface electrodes 2 provided to both ends of the top face of substrate 1;
- base layer 3 made of epoxy resin formed on the top face of substrate 1;
- element 4 electrically connected to the pair of surface electrodes 2 on the top face of base layer 3;
- insulating layer 5 covering element 4; and
- a pair of shoulder electrode layers 6 formed on both ends of substrate 1.

Base layer 3 of the foregoing conventional circuit protecting element; however, is made of epoxy resin having a low heat resistance, so that its shape becomes unstable due to the heat produced by a laser beam with which trimming grooves are formed on element 4. This unstable shape of base layer 3 sometimes causes the shape of element 4 to be unstable, which invites dispersion in the blowout characteristics of the circuit protecting element.

Patent Document 1: Unexamined Japanese Patent Application Publication No. H05-225892

SUMMARY OF INVENTION

The present invention addresses the problem discussed above, and aims to provide a circuit protecting element of which blowout characteristics are stable. The circuit protecting element of the present invention comprises the following structural elements:

- an insulating substrate;
- a pair of surface electrodes provided to both ends of the top face of the insulating substrate;
- a base layer formed on the top face of the substrate such that the base layer is connected to the pair of surface electrodes;
- an element covering the base layer, bridging the pair of surface electrodes, and also electrically connected to the pair of surface electrodes; and
- an insulating layer covering the element, wherein the base layer is formed of a mixture of diatom earth and silicone resin.

Since the diatom earth and the silicone resin forming the base layer are excellent in the heat resistance, the base layer can be prevented its shape from being unstable caused by the heat produced by a laser beam with which the trimming grooves are formed on the element. As a result, the element becomes stable in its shape, so that the blowout characteristics can be stabilized.

BRIEF DESCRIPTION OF THE DRAWINGS

FIG. 9 shows a sectional view of a conventional circuit protecting element.

DESCRIPTION OF REFERENCE MARKS

Figure 1:
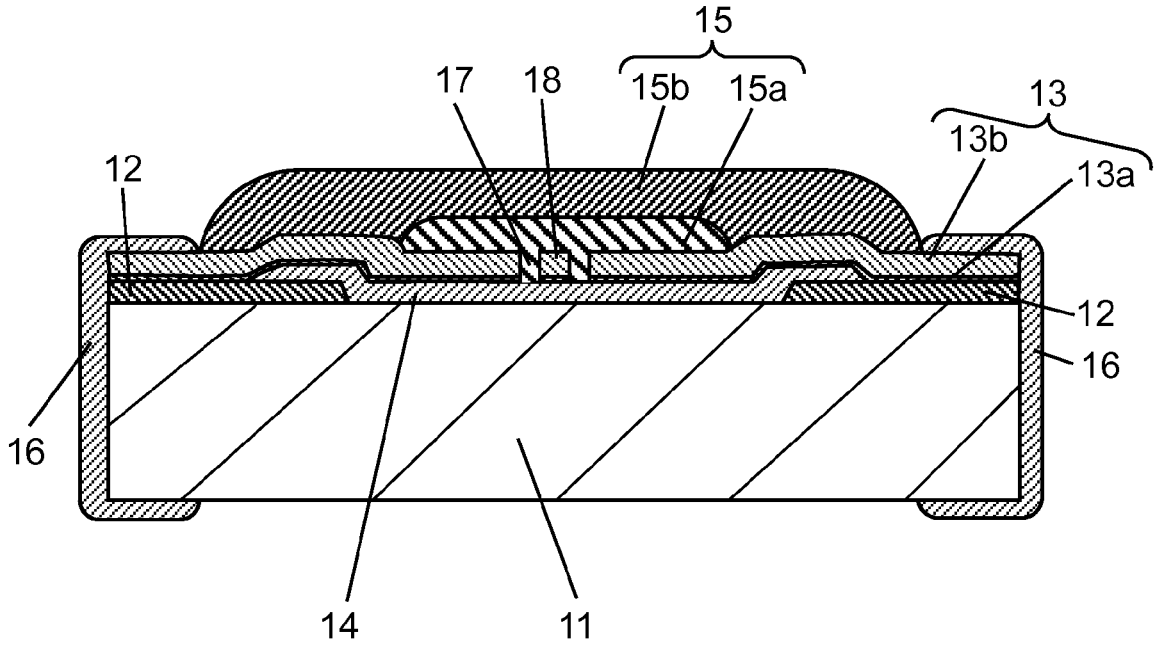
FIG. 1 shows a sectional view of a circuit protecting element in accordance with an embodiment of the present invention.

11 insulating substrate
12 surface electrode
13 element
13*a* first element
13*b* second element
14 base layer
15 insulating layer
15*a* first insulating layer
15*b* second insulating layer
16 shoulder electrode layer
17 trimming groove
18 blowout section
21 sheet-like insulating substrate
22*a*, 22*b* dividing groove
23 dummy electrode
23*a* lateral dummy section
23*b* vertical dummy section
24 section
25*a*, 25*b* trimming groove for forming a blown-out section
26*a*, 26*b*, 26*c*, 26*d*, 26*e*, 26*f* trimming groove for adjusting a resistance value
27 open-cut groove

PREFERRED EMBODIMENT OF INVENTION

Figure 2:
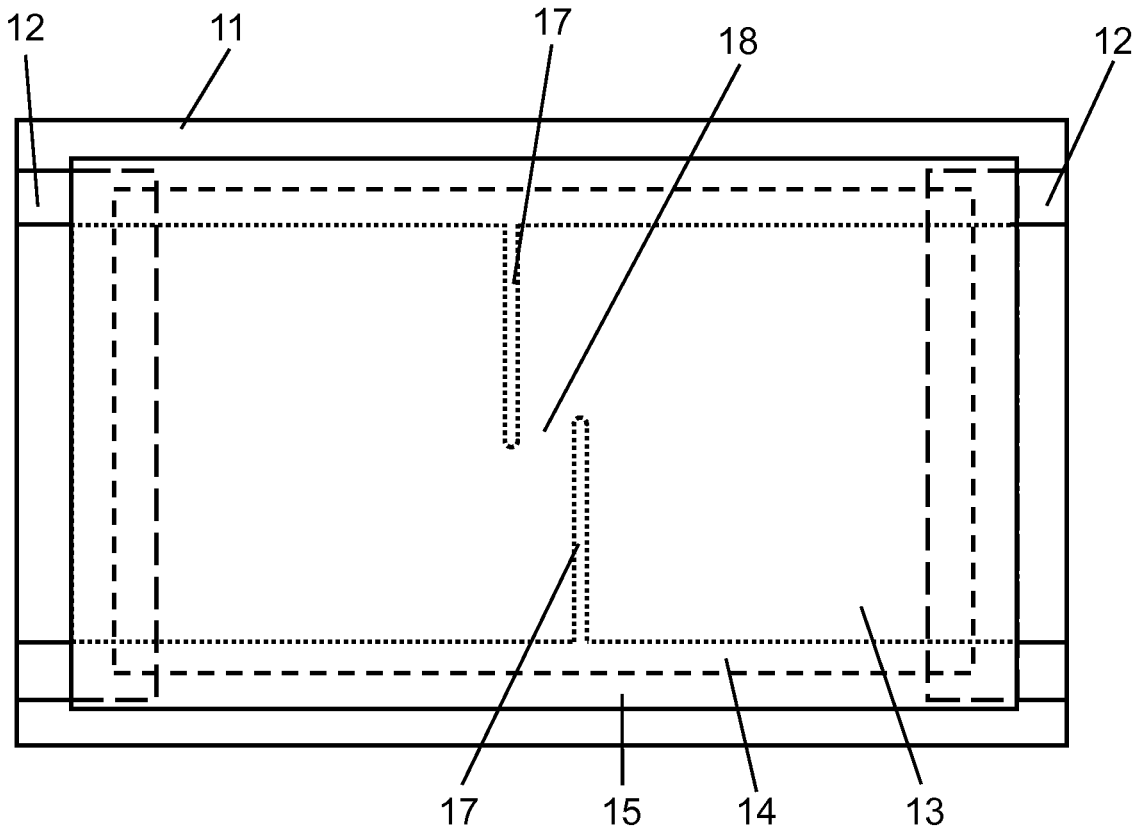
FIG. 2 shows a top view of an essential part of the circuit protecting element in accordance with the embodiment of the present invention.

An exemplary embodiment of the present invention is demonstrated hereinafter with reference to the accompanying drawings. FIG. 1 shows a sectional view of a circuit protecting element in accordance with the embodiment of the present invention. FIG. 2 shows a top view of an essential part of the circuit protecting element.

As shown in FIGS. 1 and 2, the circuit protecting element in accordance with this embodiment comprises the following structural elements:

insulating substrate 11;

a pair of surface electrodes 12 provided to both ends of the top face of insulating substrate 11;

base layer 14 made of a mixture of diatom earth and silicone resin and formed on the top face of substrate 11 such that base layer 14 is connected to the pair of surface electrodes 12;

element 13 covering base layer 14, bridging the pair of surface electrodes 12, and also electrically connected to the pair of surface electrodes 12, and formed of first element 13*a* (thin film layer) and second element 13*b* (plated layer); and insulating layer 15 covering element 13.

Element 13 includes trimming grooves 17, so that element 13 is shaped like meanders.

To be more specific about the foregoing structure, insulating substrate 11 is shaped like a square, and contains $Al_2O_3$ in the range of 55-96%. The pair of surface electrodes 12 is provided to both the ends of the top face of substrate 11, and is formed by printing Ag on the top face. Element 13 is provided on the top faces of surface electrodes 12 and base layer 14 such that element 13 can cover the entire surface of substrate 11.

First element 13*a* is formed by sputtering Ti, Cu or Cr, CuNi in this order, and second element 13*b* is formed by electrolytic plating or electroless plating Ni, Cu, Ag in this order onto first element 13*a* that works as a base for the plating.

At the center of element 13, trimming groove 17 is formed with a laser beam at two places, i.e. from the upper side of element 13 toward the center, and from the lower side toward the center, namely, the grooves are formed along the vertical direction in FIG. 2 toward the center. The region surrounded by these two grooves forms blowout section 18 which is supposed to blow out and break when an over current flows. Blowout section 18 thus formed has a higher density of electric current, so that element 13 confined within blowout section 18 can be blown out earlier. The circuit protecting element excellent in responsiveness thus can be produced, and the formation of another trimming groove 17 allows for the adjusting of a resistance value.

As shown in FIG. 2, element 13 is formed such that its lateral wall (a side of element 13 along vertical direction in FIG. 2) will not bulge out of base layer 14. This structure prevents element 13 from touching insulating substrate 11, so that the diffusion of the heat of substrate 13 into substrate 11 can be reduced. As a result, the circuit protecting element excellent in responsiveness can be produced.

Blowout section 18 can be covered with the metal, such as Sn, Zn, or Al, having a melting point lower than that of element 13. This preparation allows the metal having the lower melting point to melt faster than other parts, so that element 13 confined within blowout section 18 can be blown out faster. As a result, the circuit protecting element excellent in responsiveness can be obtained.

Base layer 14 is placed in the center of insulating substrate 11, and formed on almost the entire top face of substrate 11 such that both the ends of layer 14 can overlap with the top face of the pair of surface electrodes 12. In this case, at least parts of surface electrodes 12 are exposed. Base layer 14 does not necessarily overlap with the top face of surface electrode 12; however, the caution is preferably paid to element 13 so as not to touch substrate 11. In other words, base element 14 is placed between substrate 11 and element 13 that is located between the pair of surface electrodes 12.

On top of that, base layer 14 is formed of the mixture of diatom earth and silicone resin, and the heat conductivities of these materials are not greater than 0.2 W/m·K, so that the diffusion of the heat from element 13 into substrate 11 can be reduced. As a result, the circuit protecting element excellent in responsiveness can be obtained. Base layer 14 contains diatom earth at a mixed ratio in the range of 50-90 volumetric %, and the more preferable range is 55-70 volumetric %.

The diatom earth is used as one of the materials for wall plate or heat-proof brick, so that it is fire-proof and lightweight soil having an ultra-porous and hyperfine structure. Since the diatom earth is fire-proof, the blowout characteristics can be kept stable although element 13 becomes hot due to an over-current. Since element 13 becomes hot due to the over-current, the resin to be mixed with the diatom earth should be fire-proof. The silicone resin is best suited for this purpose, and epoxy resin and others do not suit to this application because they are inferior to the silicone resin in fire resistance. Both of the diatom earth and the silicone resin are available in ample volume at a low cost, so that the productivity can be improved.

On top of that, the silicone resin forming base layer 14 is colored by mixing a pigment of blue or red except white in approx. 1 wt % with the silicone resin. The insulating substrate including alumina looks, in general, white, so that if element 13 encounters a defect such as a print blur or a fracture, the defect cannot be recognized on the white-looking substrate. However, since this embodiment colors the silicone resin as discussed above, the defect can be recognized and then screened with ease by human eyes or an automatic inspection.

Base layer 14 can be formed not only in the center but also on almost all of the top face of substrate 11, and then the pair of surface electrodes 12 can be formed on both ends of base layer 14.

Base layer 14 can be formed by mixing silicone resin with alumina powder. In this case, since the silicone resin has the heat conductivity not greater than 0.2 W/m·K, so that the diffusion of the heat from element 13 into substrate 11 can be reduced. As a result, the circuit protecting element excellent in responsiveness can be obtained. Base layer 14 contains the alumina powder at a mixed ratio in the range of 50-80 volumetric %, and the heated alumina powder can tightly bond to alumina or silica contained in substrate 11. On top of that, the silicone resin can strongly adhere to the alumina of substrate 11. Base layer 14 thus adheres to substrate 11 more strongly.

If base layer 14 contains the alumina powder at a mixed ratio over 80 volumetric %, its heat conductivity increases due to the greater amount of the alumina powder, so that element 13 resists increasing its temperature even if an over current flows. As a result, the blowout characteristics of element 13 are degraded, and thixotropy of base element 14 is also degraded, which are not favorable for handling the circuit protecting element. On the other hand, if base layer 14 contains the alumina powder at a mixed ratio less than 50 volumetric %, the content ratio of the resin increases in base layer 14, so that base layer 14 tends to move its location due to the heat or stress when first element 13*a* is formed by the sputtering. First element 13*a* is thus subjected to cracks, so that the mixed ratio of the alumina powder at less than 50 volumetric % is not favorable.

The alumina powder to be mixed with silicone resin can be replaced with silica powder, or both of alumina powder and silica powder can be mixed with the silicone resin for forming base layer 14.

Insulating layer 15 covers element 13 and is formed of first insulating layer 15*a* made of resin such as silicone resin for covering blowout section 18 and second insulating layer 15*b* made of resin such as epoxy resin and placed on first insulating layer 15*a*.

Insulating layer 15 in parts (lateral section of layer 15) bulges out of base layer 14 as shown in FIG. 2. In other words, element 13 and base layer 14 are formed in the center of and under insulating layer 15, while no element 13 or no base layer 14 is formed under the lateral section of insulating layer 15. This structure allows insulating layer 15 in parts to directly touch insulating substrate 11, so that layer 15 can adhere to layer 14 more strongly.

Shoulder electrode layer 16 made of silver-based material is formed on both the ends of insulating substrate 11 such that shoulder electrode layer 16 overlaps with element 13 in parts. Electrode layer 16 is coated with a plated film (not shown) on its surface.

Figure 3A:
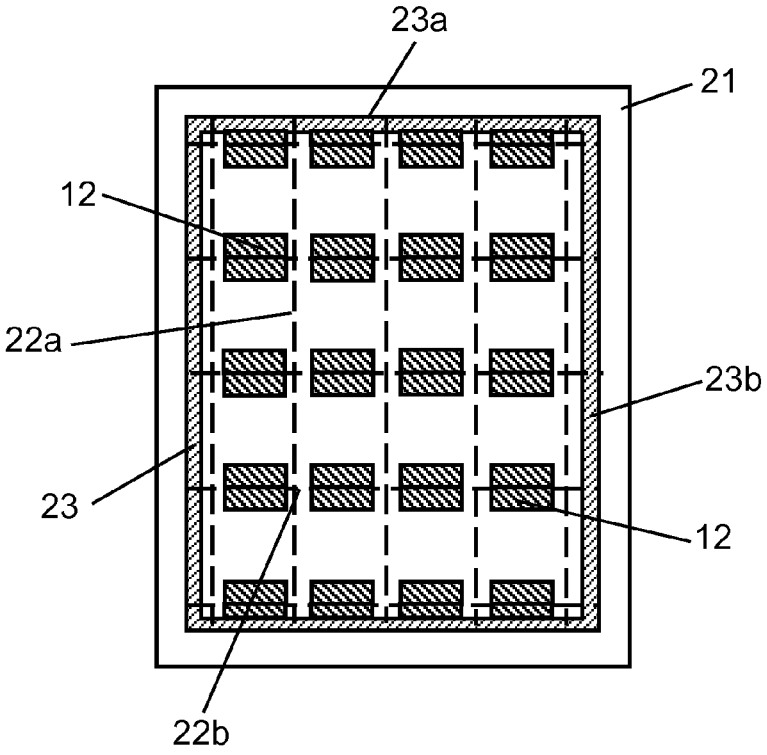
FIG. 3A shows a top view illustrating a part of a manufacturing method of the circuit protecting element in accordance with an embodiment of the present invention.

A method of manufacturing the circuit protecting element in accordance with the embodiment is demonstrated hereinafter. In FIG. 3A, firstly, prepare sheet-like and square insulating substrate 21 made of alumina containing $Al_2O_3$ in the range of 55-96%. Insulating substrate 21 includes, on its top face, multiple dividing grooves 22*a* formed in a vertical direction and dividing grooves 22*b* formed in a horizontal direction. Each one of the sections surrounded by grooves 22*a* and 22*b* is a chip-like circuit protecting element. FIG. 3A shows five grooves 22*a* and five grooves 22*b* for the description purpose; however the present invention is not limited to this structure, and other numbers of grooves can be used.

Next, print the conductive paste of palladium silver alloy, of which a main ingredient is silver paste or silver, such that the paste strides across lateral dividing grooves 22*b*. The paste is then fired for forming multiple surface electrodes 12. A pair of surface electrodes 12 is thus formed on both the ends of the top face of insulating substrate 11 in the chip-like circuit protecting element.

Form dummy electrode 23 shaped like a square frame which surrounds the region where surface electrodes 12 are formed. Dummy electrode 23 is made of the same material as surface electrode 12 and formed by printing at the same time as surface electrode 12 is printed. Dummy electrode 23 is formed of a pair of lateral dummies 23*a* and a pair of vertical dummies 23*b*. The pair of lateral dummies 23*a* is connected to multiple surface electrodes 12. Dummy electrode 23 can be formed before or after the formation of surface electrodes 12.

Figure 3B:
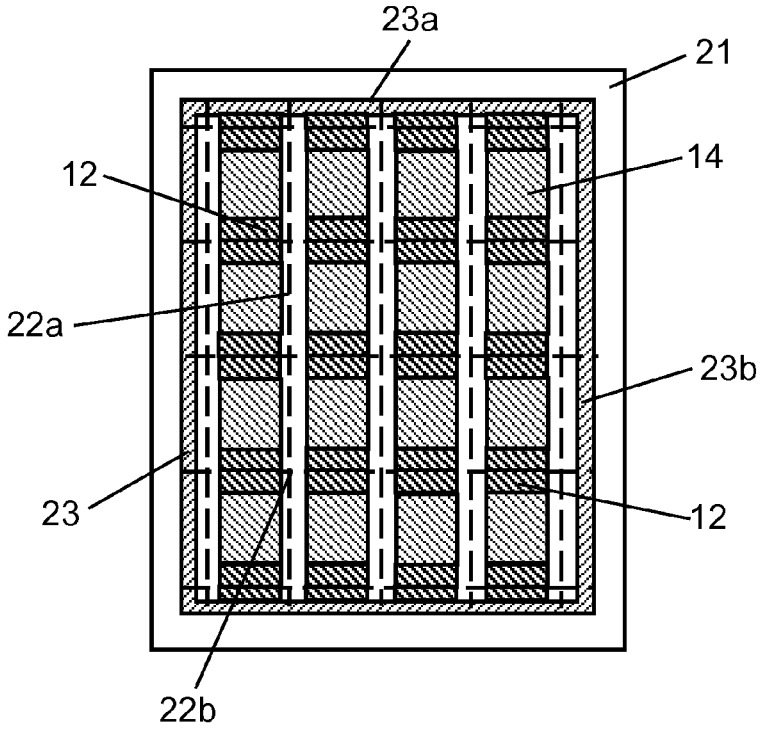
FIG. 3B shows a top view illustrating a part of a manufacturing method of the circuit protecting element in accordance with an embodiment of the present invention.

Next, as shown in FIG. 3B, print the paste on the top face of insulating substrate 11 such that the paste can connect to surface electrode 12. This paste is a mixture of organic solvent, diatom earth, and silicone resin. The diatom earth is mixed in the range of 50-90 volumetric %. Then the paste is heated at 150-200° C. to be hardened for vaporizing the organic solvent. Base layer 14 is thus formed, and at least parts of surface electrodes 12 are to be exposed.

The mixture of diatom earth in base layer 14 in the range of 50-90 volumetric % allows decreasing the difference in heat shrinkage rates between base layer 14 and first element 13*a* (thin film layer) formed by the sputtering. As a result, first element 13*a* can be free from cracks produced by the heat during the sputtering, so that the locations of element 13 and base layer 14 can be stabilized, which allows stabilizing the location of trimming grooves 17.

The silicone resin colored in blue allows for the recognition and screening of a defect on element 13 with ease by human eyes or an automatic inspection machine.

On top of that, a rear electrode (not shown) can be formed by printing and firing the paste made of palladium silver alloy, of which major ingredient is silver paste or silver, in order to stabilize the circuit protecting element when the element is mounted to a device.

Figure 4A:
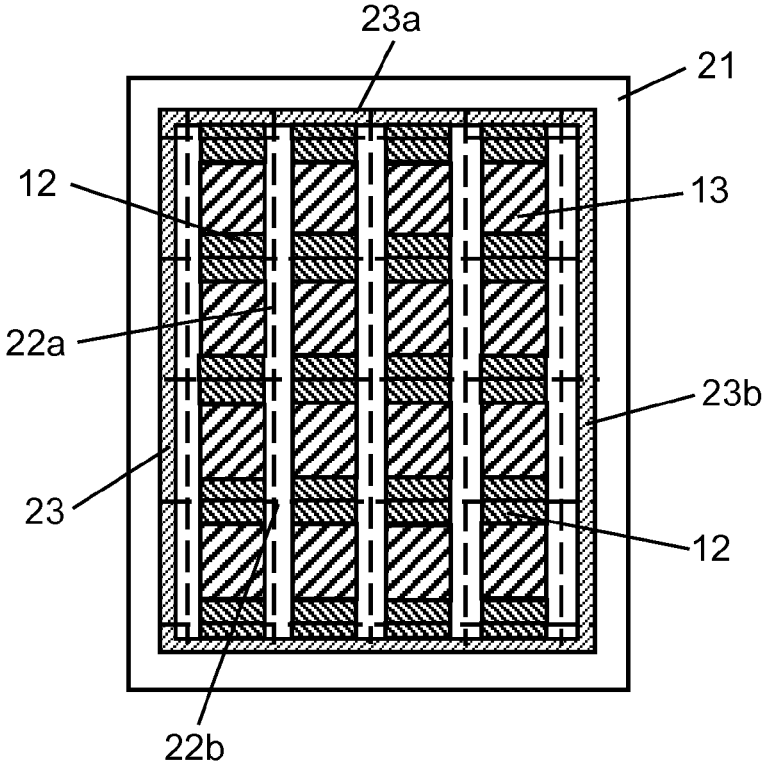
FIG. 4A shows a top view illustrating a part of a manufacturing method of the circuit protecting element in accordance an embodiment of the present invention.

Then form element 13 on the top faces of base layer 14 and the pair of surface electrodes 12 as shown in FIG. 4A. Element 13 bridges the pair of electrodes 12 so that it can electrically connect thereto. Element 13 is formed of first element 13*a* and second element 13*b*. In FIG. 1, sputter Ti, Cu or Cr, CuNi in this order onto base layer 14 and onto surface electrodes 12, so that first element 13*a* is provided so as not to override the width of base layer 14. Second element 13*b* is formed by electrolytic plating or electroless plating Ni, Cu, Ag in this order onto first element 13*a* working as a base for the plating. Element 13 is thus formed.

When first element 13*a* is formed, the sputtering is carried out while sheet-like insulating substrate 21 is heated from the base layer side because the heat is accumulated in base layer 14, which can be thus kept hot so that first element 13*a* can be formed quickly. When second element 13*b* is formed by the electrolytic plating, one of dummy electrodes 23 is connected to a power feeder section. This preparation allows second element 13*b* to be formed with ease. Use of the electroless plating method allows second elements 13*b* to be formed simultaneously on numbers of chip-like circuit protecting circuits.

Figure 4B:
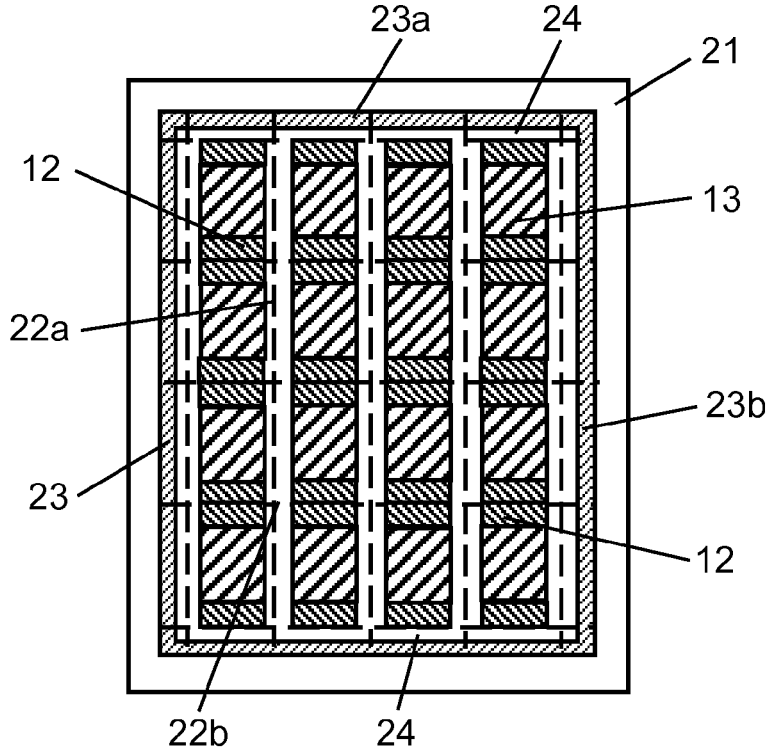
FIG. 4B shows a top view illustrating a part of a manufacturing method of the circuit protecting element in accordance with an embodiment of the present invention.

Next, as shown in FIG. 4B, sections 24 between multiple surface electrodes 12 and the pair of lateral dummies 23*a* are cut so that dummies 23*a* are brought to out of conduction with surface electrodes 12. Then measure a resistance value between a pair of surface electrodes 12, and form trimming grooves 17 on element 13. When the resistance value is measured, this preparation prohibits the electric current from flowing on the surface electrodes 12 except the pair of surface electrodes 12 of which resistance value is measured, so that the resistance value can be reliably measured. In this case, irradiate element 13 with a laser beam, thereby cutting element 13 for forming trimming groove 17 at two places along the direction from the lateral face toward the center of elements 13 confronting one another. A region surrounded by these two trimming grooves 17 forms blowout section 18 which is supposed to blow out when an over current flows through this region.

Figure 5:
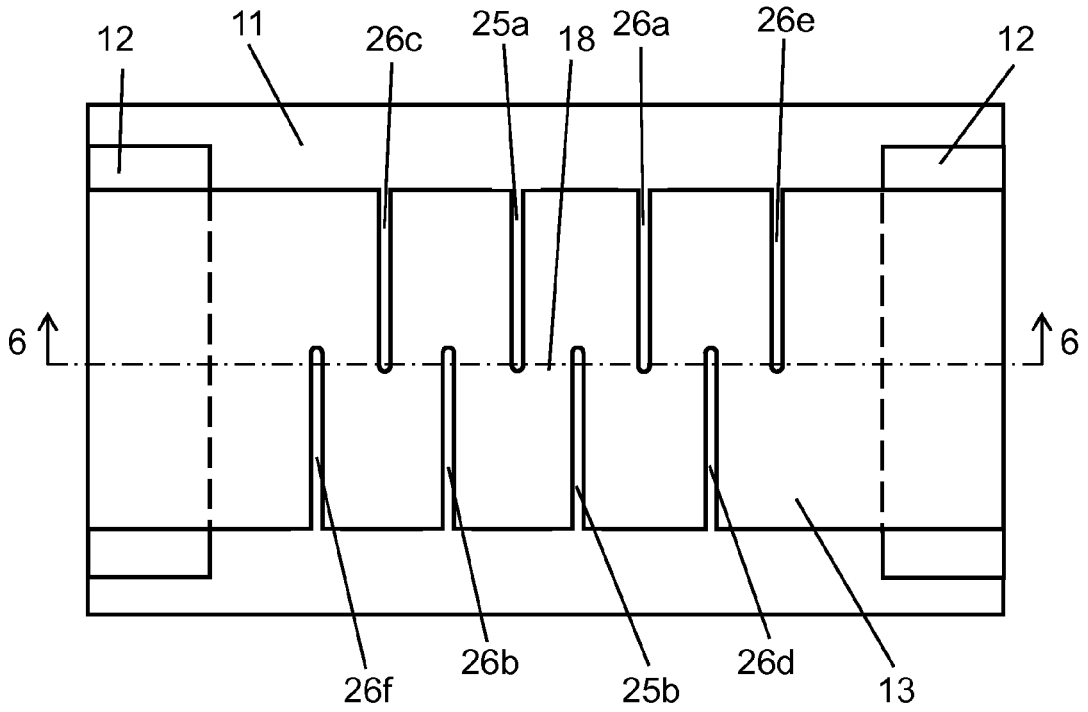
FIG. 5 shows a top view of another circuit protecting element partially cutout in accordance with an embodiment of the present invention.
Figure 6:
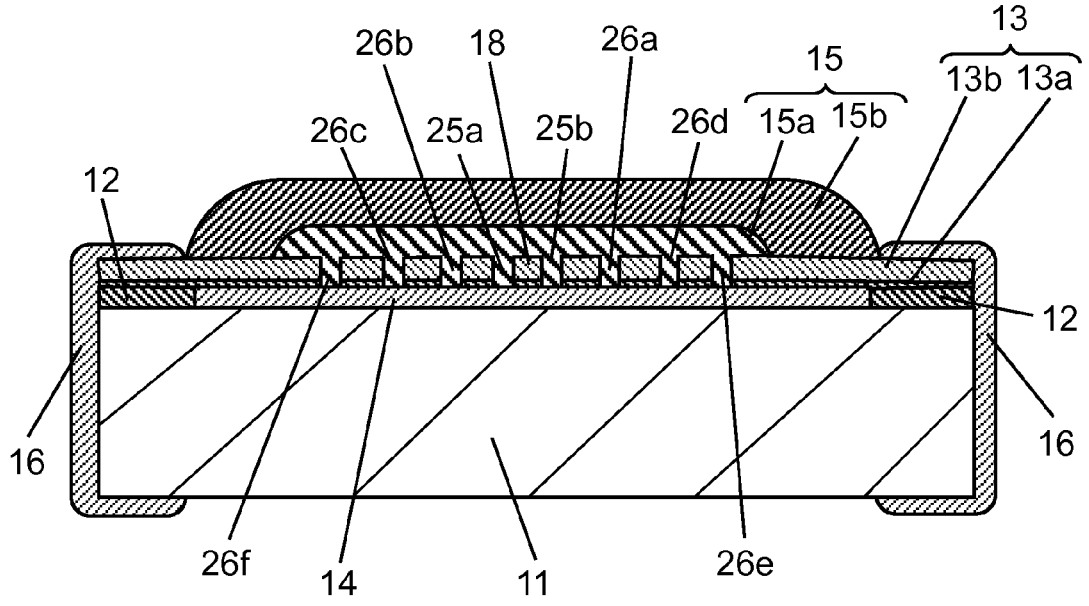
FIG. 6 shows a sectional view cut along line 6-6 in FIG. 5.

In this case, as shown in FIGS. 5 and 6, trimming grooves 17 include grooves 25*a*, 25*b* (i.e. first trimming grooves) which can be formed on element 13 for forming the blowout section, and grooves 26*a*-26*f* (i.e., second trimming grooves) which can be formed on element 13 for adjusting a resistance value.

A method of forming trimming grooves 17 is demonstrated hereinafter, i.e. forming first trimming grooves 25*a*, 25*b* for the blowout section and second trimming grooves 26*a*-26*f* for the adjustment of resistance value. First, measure a resistance value of element 13 located between a pair of surface electrodes 12. When this resistance value falls within a given range, irradiate element 13 with a laser beam at two places in the center, thereby cutting element 13 for forming a pair of first trimming grooves 25*a*, 25*b* along the direction from the lateral face toward the center of elements 13 confronting one another. The region surrounded by the pair of first trimming grooves 25*a*, 25*b* forms blowout section 18 which is supposed to blow itself out and cut off the current when an over current flows. These first grooves 25*a* and 25*b* are formed such that they overlap each other. The product of the length of the overlapped sections by the space between the overlapped sections of grooves 25*a* and 25*b*, i.e. the area (volume) of blowout section 18 will determine the blowout characteristics. Considering this fact, the pair of first trimming grooves

25*a* and 25*b* are preferably formed in advance, thereby reducing the possibility of dispersion in the blowout characteristics. Second trimming grooves 26*a*-26*f* for adjusting resistance value can be formed thereafter, and then the resistance value can be adjusted.

As discussed above, the resistance value of element 13 is firstly measured, and only when the resistance value falls within the given range, trimming grooves 25*a*, 25*b* are formed. The reason of this procedure is this: The area of blowout section 18 depends on the blowout characteristics and the rated current required by the specification, and the area will automatically determine the locations of the first trimming grooves 25*a* and 25*b*. The resistance value of element 13 after the formation of grooves 25*a*, 25*b* is also determined automatically. In other words, the formation of grooves 25*a* and 25*b* should not be carried out while the resistance value is adjusted.

Figure 7A:
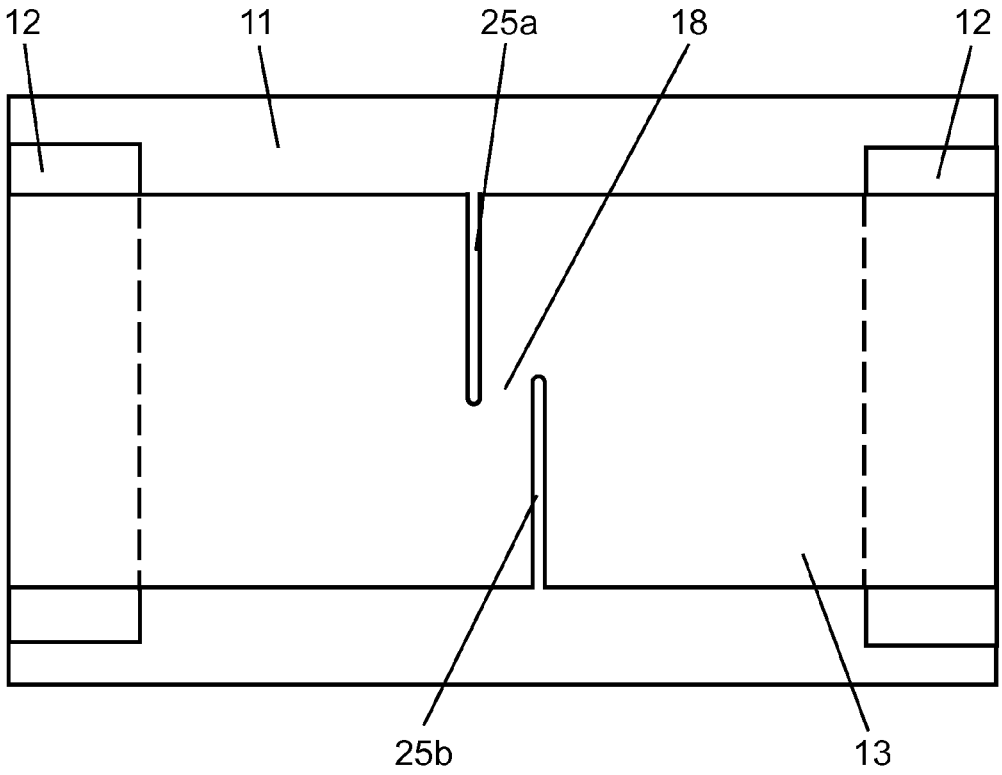
FIG. 7A shows a top view illustrating a part of a manufacturing method of a circuit protecting element partially cut in accordance with an embodiment of the present invention.
Figure 7B:
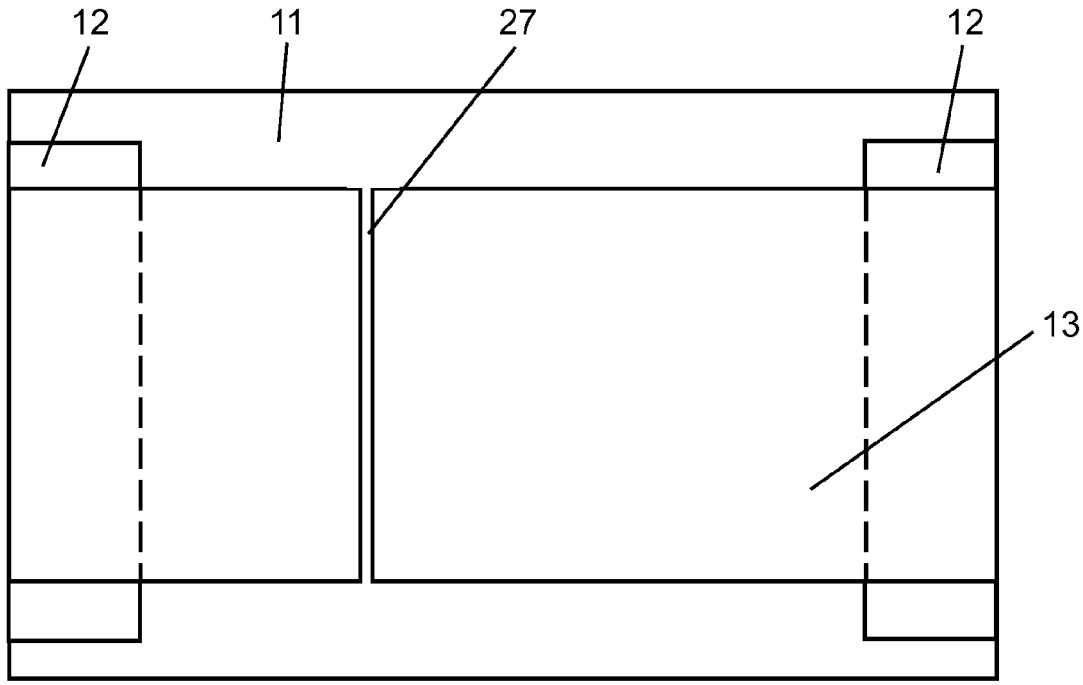
FIG. 7B shows a top view illustrating a part of a manufacturing method of a circuit protecting element partially cut in accordance with an embodiment of the present invention.

When an initial resistance value of element 13 falls outside the given range, trimming grooves 25*a*, 25*b* cannot be formed at given locations, because the blowout characteristics and the rated current required by the specification cannot be satisfied. In this case, as shown in FIG. 7B, form open-cut groove 27 by making a cut on element 13 generally with respect to the width direction of element 13, so that element 13 becomes open. If this element 13 without grooves 25*a*, 25*b* due to its resistance value falling outside the given value has a resistance value close to that of a finished product, the work of making a cut allows preventing this element 13 from being judged as a non-defective product although the blowout section is not formed.

Figure 8A:
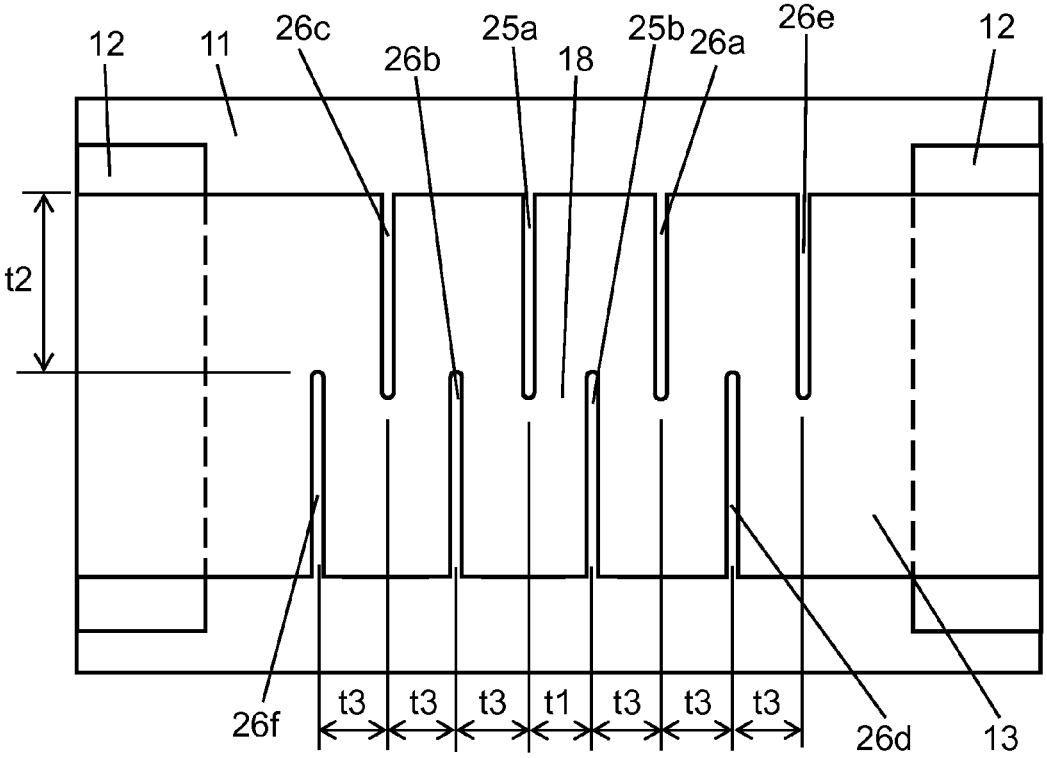
FIG. 8A shows a top view illustrating a part of a manufacturing method of a circuit protecting element partially cut in accordance with an embodiment of the present invention.

Next, measure the resistance value of element 13 after the formation of grooves 25*a* and 25*b*. Only when the resistance value falls within the given range, irradiate elements 13 on both sides of grooves 25*a* and 25*b* with a laser beam, thereby cutting these elements along the direction from the lateral face toward the center of elements 13 confronting each other as shown in FIG. 8A. Then form second trimming grooves 26*a*-26*f* sequentially for adjusting resistance value. The formation of grooves 25*a*, 25*b*, and 26*a*-26*f* makes elements 13 in a meandrous pattern.

In this case, the second trimming grooves 26*a*, 26*c*, 26*e* for the adjustment of the resistance value are formed on the same side where one of the first trimming grooves 25*a* for the forming of the blowout section is formed. The second trimming grooves 26*b*, 26*d*, 26*f* for the adjustment of the resistance value are formed on the same side where the other one of the first trimming grooves 25*b* for the blowout section is formed. To be more specific, on the left side of and closer to the first groove 25*a*, the second grooves 26*b*, 26*c*, 26*f* are formed in this order. On the right side of and closer to the other first groove 25*b*, the second grooves 26*a*, 26*d*, 26*e* are formed in this order.

The resistance value of element 13 after the formation of trimming grooves 25*a* and 25*b* is measured, and only when the value falls within a given range, the second trimming grooves 26*a*-26*f* are formed. The reason of this procedure is this: When the resistance value of element 13 is higher than the given range, the thickness of element 13 becomes thinner, so that the given blowout characteristics cannot be obtained, and it is necessary to exclude such element 13 having a thinner thickness and poor blowout characteristics. When the resistance value of element 13 after the formation of grooves 25*a* and 25*b* exceeds the range adjustable with trimming grooves 26*a*-26*f*, there is no need to form grooves 26*a*-26*f*.

Figure 8B:
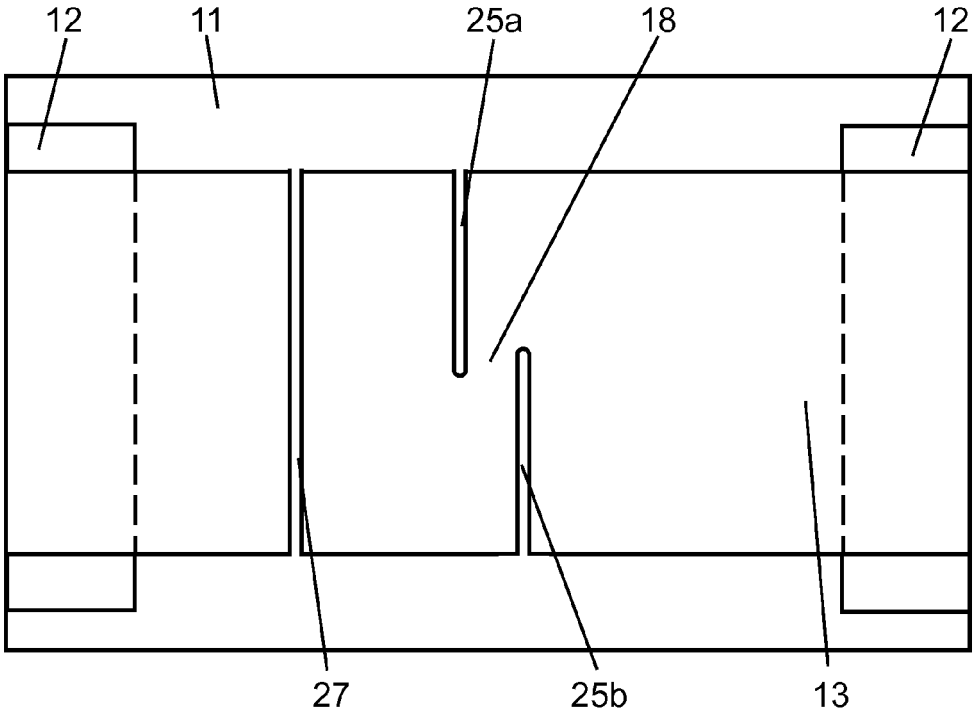
FIG. 8B shows a top view illustrating a part of a manufacturing method of a circuit protecting element partially cut in accordance with an embodiment of the present invention.

When the resistance value of element 13 after the formation of grooves 25*a* and 25*b* falls outside the given range, open-cut groove 27 can be formed as shown in FIG. 8B.

Space "t1" between the first trimming grooves 25*a* and 25*b* is set smaller than length "t2" between each one of grooves 26*a*-26*f* and the lateral face confronting each one of grooves 26*a*-26*f*, of element 13. On top of that, grooves 26*a*-26*f* adjacent to each other are spaced away by space "t3", and groove 25*a* is spaced away from groove 26*b* by space "t3", and groove 25*b* is spaced away from groove 26*a* by also space "t3", then the space "t1" is set equal to or smaller than space "t3". The foregoing relation among t1, t2, and t3 allows blowout section 18 surrounded by grooves 25*a* and 25*b* to blow themselves out reliably.

In FIG. 8A, the tips of grooves 26*a*-26*f* are located such that they protrude toward the lateral face, confronting the respective tips, of element 13 from the center line (line 6-6 in FIG. 5) drawn across the shorter sides of element 13. However, it is not necessarily to follow this instance. The lengths of grooves 26*a*-26*f* are similar to one another in FIG. 8A; however, they can be different from one another.

After the formation of trimming grooves 17 (i.e. first grooves 25*a*, 25*b* for forming the blowout section and second grooves 26*a*-26*f* for adjusting resistance value), form first insulating layer 15*a* by using resin such as silicone resin for covering at least blowout section 18. Then form second insulating layer 15*b* by using, e.g. epoxy resin, on the top face of first insulating layer 15*a*, thereby forming dual-layered insulating layer 15.

Next, apply resin silver paste onto both the ends of insulating substrate 11 such that the paste overlaps with parts of element 13, and then harden the paste, thereby forming shoulder electrode layer 16, however, layer 16 can be formed through a thin-film process such as sputtering.

Finally, form a plated film (not shown) made of dual layers, i.e. one is a nickel layer and the other is a tin layer, on the top face of shoulder electrode layer 16. The circuit protecting element in accordance with this embodiment can be thus manufactured.

Before the formation of second element 13*b*, insulating substrate 11 (sheet-like insulating substrate 21) can be pasted with a stop-off sheet (not shown) on its rear face in order to prevent the rear face, in particular, electrodes on the rear face from being plated. This preparation prevents substrate 11 from being conductive on its rear face. In this case, the stop-off sheet can be pasted onto the rear face by using a temperature of the plating solution so that the stop-off sheet can more positively adhere onto the rear face without increasing the number of the manufacturing steps. To be more specific, when second element 13*b* is formed, dip it into the plating solution, which is heated to a temperature higher than the ordinary temperature (in both the cases of the electroless plating and the electrolytic plating), so that the stop-off sheet is also heated simultaneously. The stop-off sheet is increased its adhesiveness by the heating, so that the use of the higher temperature of the plating solution can eliminate an independent heating device, and yet, the adhesiveness of the stop-off can increase.

The stop-off sheet can be formed of pressure sensitive adhesive formed on a polyvinyl chloride film which works as a supporter. The stop-off sheet can preferably closely adhere to insulating substrate 11, and can be removed with ease.

In the foregoing embodiment, base layer 14 is formed of a mixture of diatom earth and silicone resin both of which are excellent in heat resisting characteristics. This structure prevents the heat due to the laser beam from making base layer 14 unstable in shape, so that element 13 can be stable in its shape, and thus the blowout characteristics can be stabilized.

The silicone resin can enter among the particles of the diatom earth, so that base layer 14 can be fixed strongly onto substrate 11, and atmospheric moisture or the plating solution cannot enter base layer 14, so that the resistance to humidity can be improved.

Since base layer 14 is formed of the mixture of diatom earth in 50-90 volumetric % and silicone resin in 50-10 volumetric %, base layer 14 strongly adheres to insulating substrate 11, and yet the yield rate can be improved.

The study of relations among the mixture ratio of the diatom earth in volumetric %, the adhesive strength between base layer 14 and insulating substrate 11, and the presence of cracks on first element 13*a* is done through the following procedures, and the study results in the following facts: First, the adhesive strength between layer 14 and insulating substrate 11 is tested this way: Paste up a scotch tape tentatively onto base layer 14 having undergone the printing and the curing processes, then peel off the scotch tape and confirm whether or not base layer 14 is peeled off together with the scotch tape from substrate 11. When base layer 14 is not peeled off, it is determined that base layer 14 strongly adheres to substrate 11. On top of that, form first element 13*a* on base layer 14 by sputtering Ti and Cu, and observe whether or not a crack happens on first element 13*a*.

The result of the forgoing test is this: When the mixture ratio of diatom earth is not greater than 90 volumetric %, base layer 14 never peels off substrate 11; however, when the mixture ratio exceeds 90 volumetric %, some base layers 14 peel off substrate 11. When the mixture ratio of diatom earth is not less than 50 volumetric %, no cracks occur on first element 13*a*; however, when the mixture ratio is less than 50 volumetric %, cracks occur on some elements 13*a*.

Since the adhesive strength between the silicone resin and the alumina forming substrate 11 is strong, a higher mixture ratio of the silicone resin in the mixture of the diatom earth and the silicone resin, both forming base layer 14, allows the adhesive strength between base layer 14 and substrate 11 to be increased. It means that the higher mixture ratio of the silicone resin can eliminate the step of firing base layer 14 at a temperature over 1000° C., and thus base layer 14 can be bonded to substrate 11 without the firing step.

A higher mixture ratio of the diatom earth in the mixture of the diatom earth and the silicone resin, both forming base layer 14, allows reducing a difference in heat shrinkable properties between element 13*a* formed by sputtering and base layer 14. First element 13*a* can be thus free from the cracks due to the difference in the heat shrinkage properties between first element 13*a* and base layer 14, so that the yield rate can be improved.

Base layer 14 formed of silicone resin, alumina powder, and silica powder allows itself to be stable in shape against the heat produced by the laser beam when trimming grooves 17 are formed by radiating the laser beam, because those materials are excellent both in heat resistant properties and in adhesion properties to insulating substrate 11 which contains alumina. The shape of element 13 can be thus stabilized, so that the blowout characteristics can be also stabilized.

The silicone resin can enter among the particles of the alumina powder and the silica powder, so that base layer 14 can be fixed strongly onto substrate 11, and atmospheric moisture or the plating solution cannot enter base layer 14, so that the resistance to humidity can be improved.

Since base layer 14 strongly adheres to substrate 11, base layer 14 can be bonded to insulating substrate 11 without the step of firing base layer 14 at a temperature over 1000° C., so that the productivity can be improved.

In this embodiment, after first trimming grooves 25*a*, 25*b* for forming the blowout section are formed, then second trimming grooves 26*a*-26*f* for adjusting resistance value are formed. This procedure allows grooves 25*a* and 25*b* to be formed such that those grooves can satisfy the given blowout characteristics before the resistance value of element 13 is adjusted, so that the blowout characteristics can be stabilized.

Since element 13 is made of metal, the formation of trimming grooves 25*a* and 25*b* by radiating a laser beam allows blowout section 18 between grooves 25*a* and 25*b* to heighten its resistance value, which is an important factor to the blowout characteristics, than a theoretical value because of the heat produced by the laser beam. However, in this embodiment, trimming grooves 26*a*-26*f* for adjusting the resistance value are formed after the formation of grooves 25*a* and 25*b*, and the resistance value can be adjusted later than the formation of grooves 25*a* and 25*b*. The heat thus dissipates with time, so that the resistance value of blowout section 18 approaches the theoretical value. The blowout characteristics thus can be stabilized.

The resistance value is adjusted with multiple trimming grooves 25*a*, 25*b*, and 26*a*-26*f*, so that the resistance value can be stabilized.

According to the foregoing method of manufacturing the circuit protecting element in accordance with the embodiment, three of the second trimming grooves for adjusting the resistance value are formed on the left side of one first trimming groove 25*a* which is used for forming the blowout section, and another three of the second trimming grooves for adjusting the resistance value are formed on the right side of the other one of the first trimming grooves 25*b*. However, the number of the grooves for adjusting the resistance value is not always three, and they are not always formed on both sides of grooves 25*a* and 25*b* in the same quantity. The formation of them on both sides in the same quantity, however, is preferable because this structure can heighten the temperature of blowout section 18.

INDUSTRIAL APPLICABILITY

The present invention advantageously stabilizes the blowout characteristics, and is useful particularly for a circuit protecting element which blows itself out when an over current flows, thereby protecting a variety of electronic devices.

The invention claimed is:

1. A circuit protecting element comprising:

an insulating substrate;

a pair of surface electrodes formed on both ends of a top face of the insulating substrate;

a base layer disposed on the top face of the insulating substrate;

an element covering the base layer and bridging the pair of surface electrodes, and electrically connecting with the pair of surface electrodes; and an insulating layer covering the element, wherein the insulating layer is comprised of a first insulating layer, wherein the element has a plurality of trimming grooves, wherein the first insulating layer is in physical contact with the base layer via the trimming grooves, wherein none of the trimming grooves reach the insulating substrate, and wherein the element is prevented from bulging out from the base layer in a lateral direction.

2. The circuit protecting element of claim 1, wherein the base layer is formed of a mixture of diatom earth and silicone resin, and wherein the mixture of the diatom earth and the silicone resin contains the diatom earth in a range of 50-90 volumetric %.

3. The circuit protecting element of claim 1, wherein the base layer is formed of a mixture of diatom earth and silicone resin, and wherein the silicone resin of the base layer is colored.

4. The circuit protecting element of claim 1, wherein the base layer is formed of a mixture of diatom earth and silicone resin, wherein the insulating substrate contains alumina, and wherein the base layer is formed of the silicone resin mixed with at least one of alumina powder and silica powder.

5. The circuit protecting element of claim 1, wherein at least parts of the insulating substrate bulge out from the base layer.

6. The circuit protecting element of claim 1, wherein a blowout section is formed by providing the element with the plurality of trimming grooves.

7. The circuit protecting element of claim 1, wherein the base layer is formed of a mixture of diatom earth and silicone resin.

8. The circuit protecting element of claim 1, wherein the insulating layer is further comprised of a second insulating layer placed on the first insulating layer.

9. A method of manufacturing a circuit protecting element, the method comprising:

forming a pair of surface electrodes on both ends of a top face of an insulating substrate;

forming a base layer on the top face of the insulating substrate such that at least parts of the surface electrodes can be exposed;

forming an element for bridging the pair of surface electrodes on a top face of the base layer, and for electrically connecting with the pair of surface electrodes;

irradiating the element with a laser beam so as to form trimming grooves for forming a blowout section; and forming a first insulating layer so as to cover at least the blowout section, wherein the first insulating layer physically contacts the base layer via the trimming grooves, wherein none of the trimming grooves reach the insulating substrate, wherein the element comprises a first element for bridging the pair of surface electrodes and for electrically connecting with the pair of surface electrodes, and a second element for bridging the pair of surface electrodes and for electrically connecting with the pair of surface electrodes, and wherein said forming of the element includes forming the first element by a sputtering method and forming the second element on a top face of the first element by a plating method.

10. The manufacturing method of claim 9, further comprising:

after said forming of the first insulating layer, forming a second insulating layer on a top face of the first insulating layer.

11. A method of manufacturing a circuit protecting element, the method comprising:

forming a pair of surface electrodes on both ends of a top face of an insulating substrate;

forming a base layer on the top face of the insulating substrate such that at least parts of the surface electrodes can be exposed;

forming an element for bridging the pair of surface electrodes on a top face of the base layer, and for electrically connecting with the pair of surface electrodes;

irradiating the element with a laser beam so as to form a pair of first trimming grooves for forming a blowout section, and so as to form a plurality of second trimming grooves for adjusting a resistance value; and forming a first insulating layer so as to cover at least the blowout section, wherein the first insulating layer physically contacts the base layer via the first and second trimming grooves, wherein the first and second trimming grooves do not reach the insulating substrate, and wherein the pair of first trimming grooves for forming the blowout section are formed before the plurality of second trimming grooves for adjusting the resistance value are formed.

12. The manufacturing method of claim 11, wherein a space between the pair of first trimming grooves for forming the blowout section is set to be identical to or smaller than a space between adjacent ones of the plurality of second trimming grooves for adjusting the resistance value, and to be identical to or smaller than a space between each of the first trimming grooves for forming the blowout section and a respective adjacent one of the second trimming grooves for adjusting the resistance value.

13. The manufacturing method of claim 11, wherein the pair of first trimming grooves for forming the blowout section are formed only when a resistance value of the element, on which the pair of first trimming grooves for forming the blowout section are not yet formed, falls within a given range.

14. The manufacturing method of claim 11, wherein the plurality of second trimming grooves for adjusting the resistance value are formed only when a resistance value of the element with the pair of first trimming grooves for forming the blowout section formed thereon falls within a given range.

15. The manufacturing method of claim 13, wherein an open-cut groove is formed on the element when a resistance value of the element, on which the pair of first trimming grooves for forming the blowout section are not yet formed, falls outside the given range.

16. The manufacturing method of claim 11, wherein the base layer is formed of a mixture of diatom earth and silicone resin.

17. The manufacturing method of claim 11, further comprising:

after said forming of the first insulating layer, forming a second insulating layer on a top face of the first insulating layer.

18. The manufacturing method of claim 11, wherein the element can form meanders.

19. The manufacturing method of claim 9, wherein the base layer is formed of a mixture of diatom earth and silicone resin.

20. The manufacturing method of claim 9, wherein the second element is formed by an electroless plating method.

21. The manufacturing method of claim 9, wherein said forming of the first element comprises forming a plurality of first elements while the insulating substrate is heated from the base layer side.

22. The manufacturing method of claim 9, wherein a stop-off sheet is pasted to a rear face of the insulating substrate before the second element is formed for preventing plating material from attaching to the rear face.

23. The manufacturing method of claim 22, wherein the stop-off sheet is pasted to the rear face by using a temperature of a plating solution.

* * * * *